US007316172B1

(12) United States Patent
Chen et al.

(10) Patent No.: US 7,316,172 B1
(45) Date of Patent: Jan. 8, 2008

(54) HANDHELD TOOL

(75) Inventors: Sue-Fen Chen, Tainan (TW); Joseph Chen, Changhua County (TW)

(73) Assignee: Chen, Sue Fen, Tainan (TW)

( * ) Notice: Subject to any disclaimer, the term of this patent is extended or adjusted under 35 U.S.C. 154(b) by 0 days.

(21) Appl. No.: 11/604,310

(22) Filed: Nov. 27, 2006

(30) Foreign Application Priority Data

Nov. 3, 2006 (TW) ..... 95219500 U

(51) Int. Cl.
*B25B 23/16* (2006.01)
*B25B 13/00* (2006.01)

(52) U.S. Cl. ..... 81/177.2; 81/125.1

(58) Field of Classification Search ..... 81/177.2, 81/177.6, 177.1, 125.1
See application file for complete search history.

(56) References Cited

U.S. PATENT DOCUMENTS 1,003,997 A * 9/1911 Dudly, Sr. ..... 81/125.1
1,186,807 A * 6/1916 Litomy ..... 81/177.6
1,402,373 A * 1/1922 Palmer ..... 81/125.1
6,550,357 B1 * 4/2003 Freeman ..... 81/177.2
6,691,595 B2 2/2004 Hsien

* cited by examiner

*Primary Examiner*—Hadi Shakeri
(74) *Attorney, Agent, or Firm*—Bacon & Thomas PLLC

(57) ABSTRACT

A handheld tool includes a first handle with a first driving portion and the second handle with a second driving portion. The second handle, which is located under the first handle, is connected to f the first handle for turning relative to the first handle between a retracted position and an unretracted position and is positioned at the retracted position and the unretracted position respectively. The second driving portion of the second handle is adjacent to the first driving portion of the first handle when the second handle is turned to the retracted position, and the second driving portion keeps a longest distance from the first driving portion when the second handle is turned to the unretracted position.

15 Claims, 17 Drawing Sheets

HANDHELD TOOL

BACKGROUND OF THE INVENTION

1. Field of the Invention

The present invention relates generally to a hand tool, and more particularly to a handheld, which may change its length for storage and operation.

2. Description of the Related Art

As shown in FIG. 1, a conventional wrench 1 includes two driving members 1*a*, 1*b* at opposite ends thereof to turn objects, such as nuts or bolts. In some specific workplace, it needs a long wrench for operation. The longer wrench has a greater arm for turning but it needs a large space for storage.

To overcome above drawback, an improved bendable wrench 2, as shown in FIG. 2, was provided. The wrench 2 has two driving members 2*a*, 2*b* and a plurality of chain members 2*c* jointed together. The chain members 2*c* make the wrench 2 bendable but user always has problem to operate the wrench 2 because there are too much chain members 2*c*. Sometime, the chain members 2*c* hurt user when he/she holds the wrench 2 and exerts it to turn something. The wrench 2 is not a well-developed product.

Another retractable wrench 3, as shown in FIG. 3, includes a tube 4 and two wrenching members 5, 6 inserted into opposite ends of the tube 4 respectively. Each of the wrenching members 5, 6 has a slot 5*a*, 6*a*. Two pins 7 inserted into bores (not shown) on the tube 4 and inserted into the slots 5*a*, 6*a* of the wrenching members 5, 6 respectively to fix the wrenching members 5, 6. The wrench 3 is taught in U.S. Pat. No. 6,691,595. The wrenching members 5, 6 may be moved outwards and inwards relative to the tube 4 to change a length of the wrench 3. But the pins 7 is unable to fix the wrenching members 5, 6 firmly, so that the wrenching members 5, 6 move unexpectedly when user operate the wrench 3.

SUMMARY OF THE INVENTION

The primary objective of the present invention is to provide a handheld tool, which can change its length for storage and operation.

According to the objectives of the present invention, a handheld tool includes a first handle and the second handle. The first handle has a first driving portion and a turning portion at opposite ends thereof. The second handle, which is located under the first handle, has second driving portion and a connecting portion to be connected to the turning portion of the first handle for turning relative to the first handle between a retracted position and an unretracted position. The second driving portion of the second handle is adjacent to the first driving portion of the first handle when the second handle is turned to the retracted position, and the second driving portion keeps a longest distance from the first driving portion when, the second handle is turned to the unretracted position.

DETAILED DESCRIPTION OF THE INVENTION

The present invention provides a handheld tool for turning fasteners, such as bolt, nuts or other objects that is hard to be turned by hand. The handheld tool includes two handles jointed together and provides locking means to position the handles that prevent the handles move unexpectedly when they are turned to the desire positions.

Figure 1:
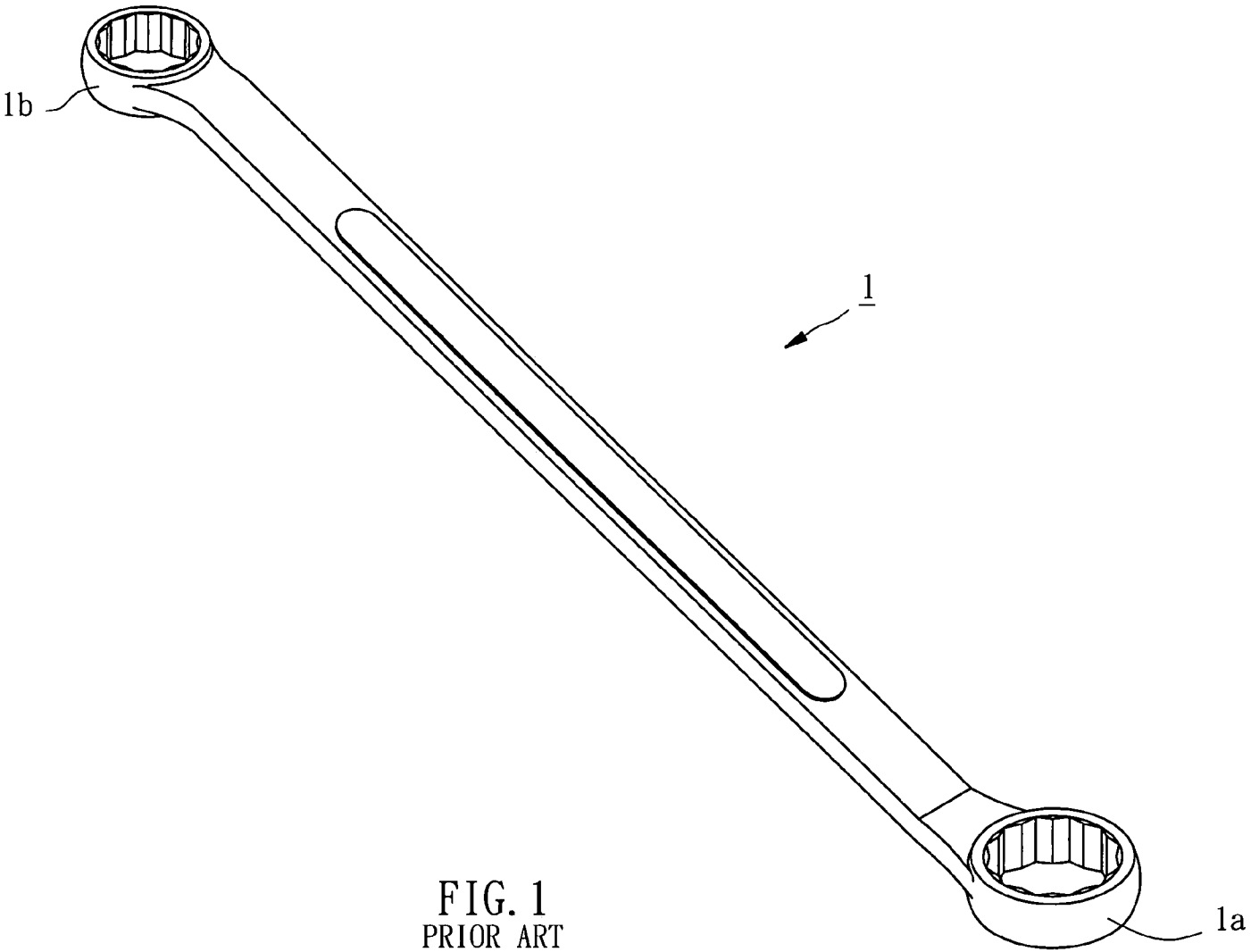
FIG. 1 PRIOR ART
FIG. 1 is a perspective view of the first conventional wrench.
Figure 2:
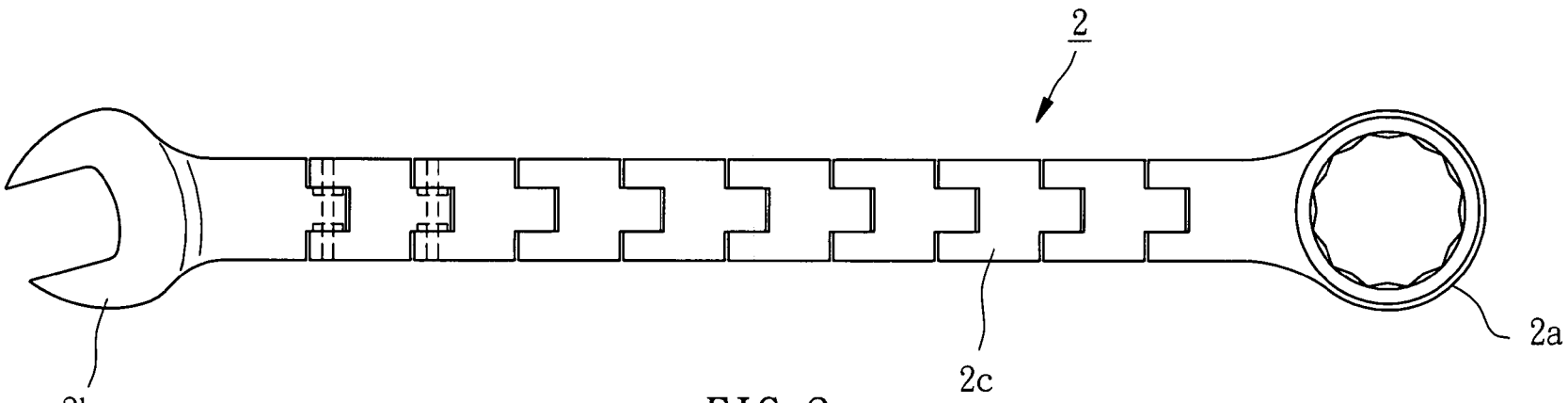
FIG. 2 PRIOR ART
FIG. 2 is a top view of the second conventional wrench.
Figure 3:
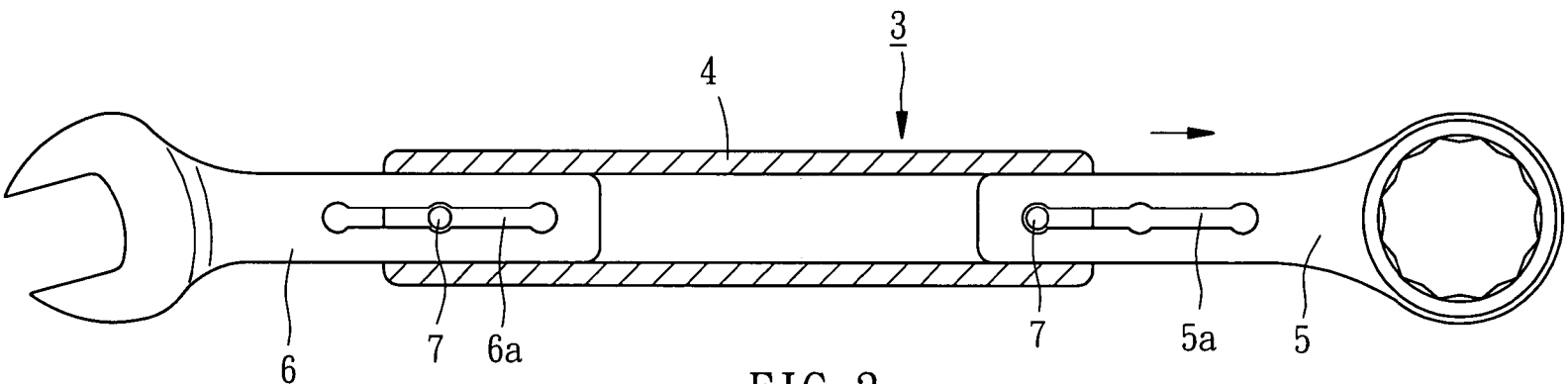
FIG. 3 PRIOR ART
FIG. 3 is a sectional view of the third conventional wrench.
Figure 4:
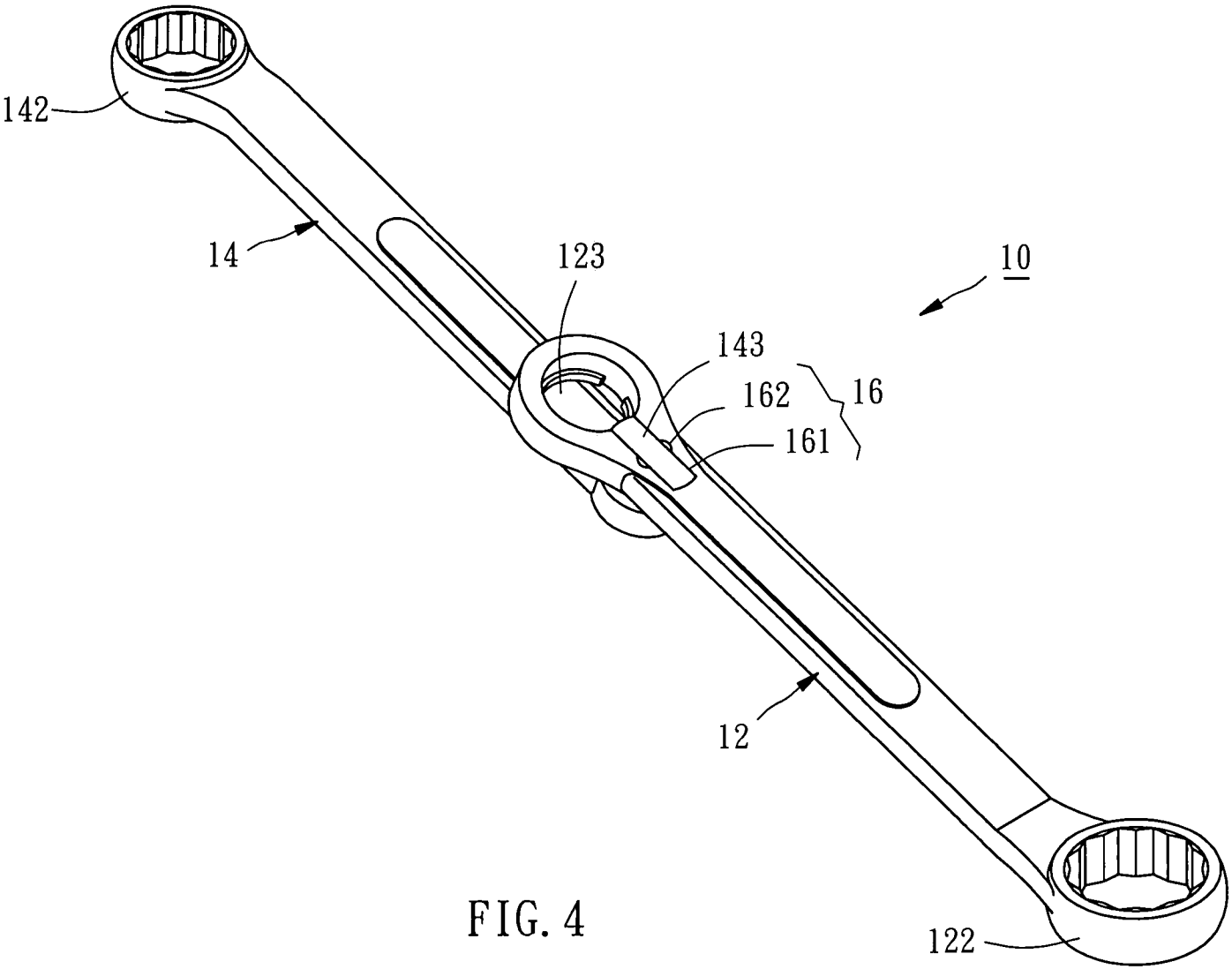
FIG. 4 is a perspective view of a first preferred embodiment of the present invention.

As shown in FIG. 4, a handheld tool 10 of the first preferred embodiment of the present invention includes a first handle 12, a second handle 14 and locking means 16.

Figure 5:
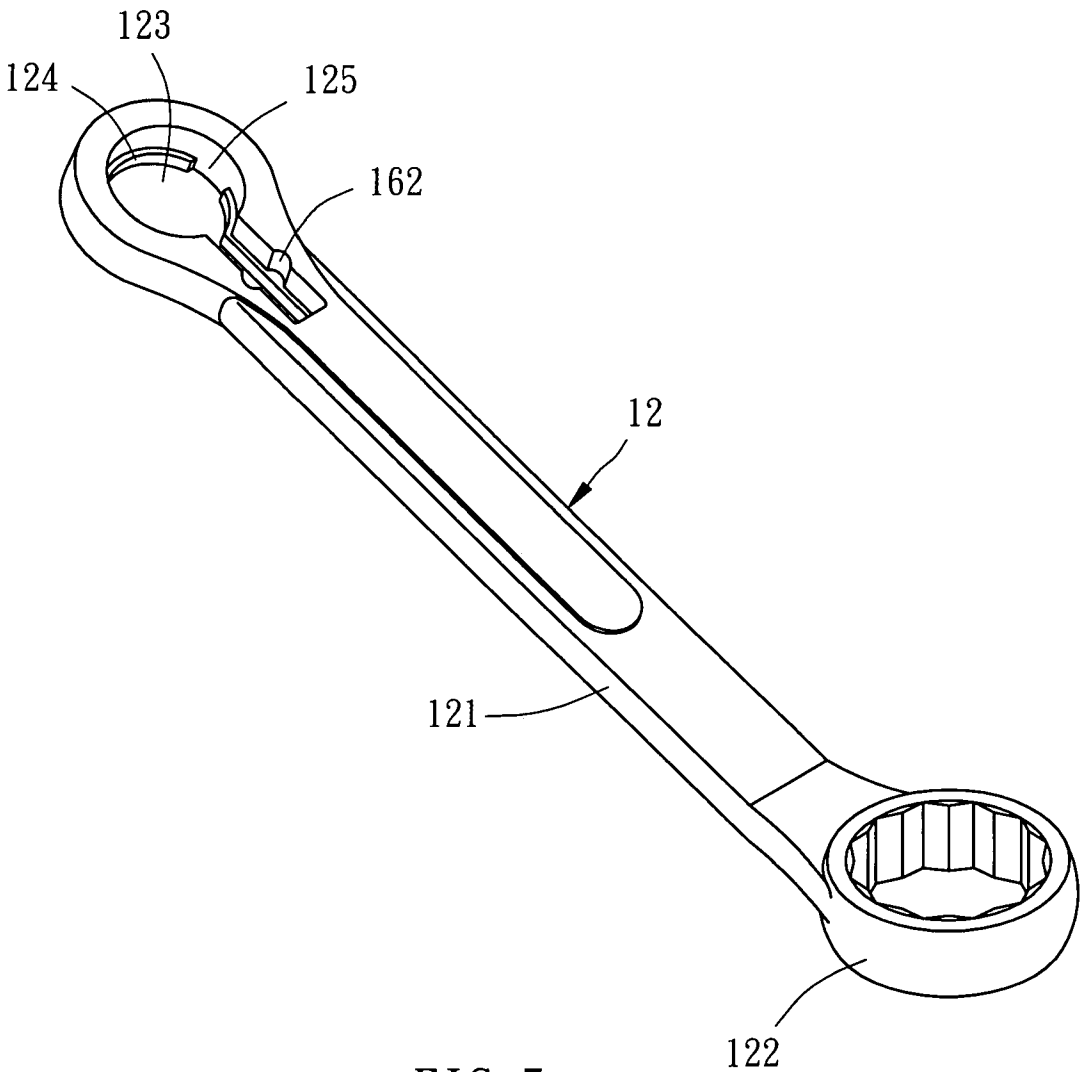
FIG. 5 is a perspective view of the first handle of the first preferred embodiment of the present invention.
Figure 6:
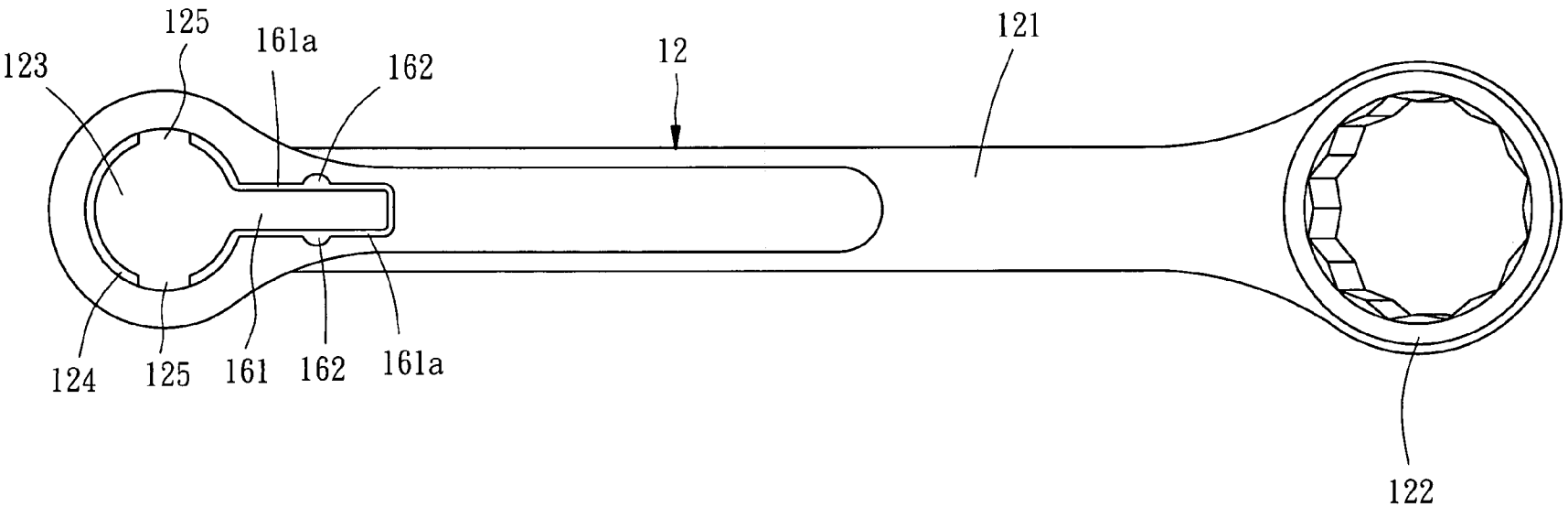
FIG. 6 is a top view of the first handle of the first preferred embodiment of the present invention.

As shown in FIG. 5 and FIG. 6, the first handle 12 has a body 121 with a predetermined length for holding by hand, a first driving portion 122 and a turning space 123. The turning space 123 is a round hole. The first driving portion 122 can turn fasteners, such as bolt, nuts or other objects that is hard to be turned by hand. The first handle 12 has an annular stop wall 124 on a bottom side around the round hole 123, on which two gaps 125 are provided.

Figure 7:
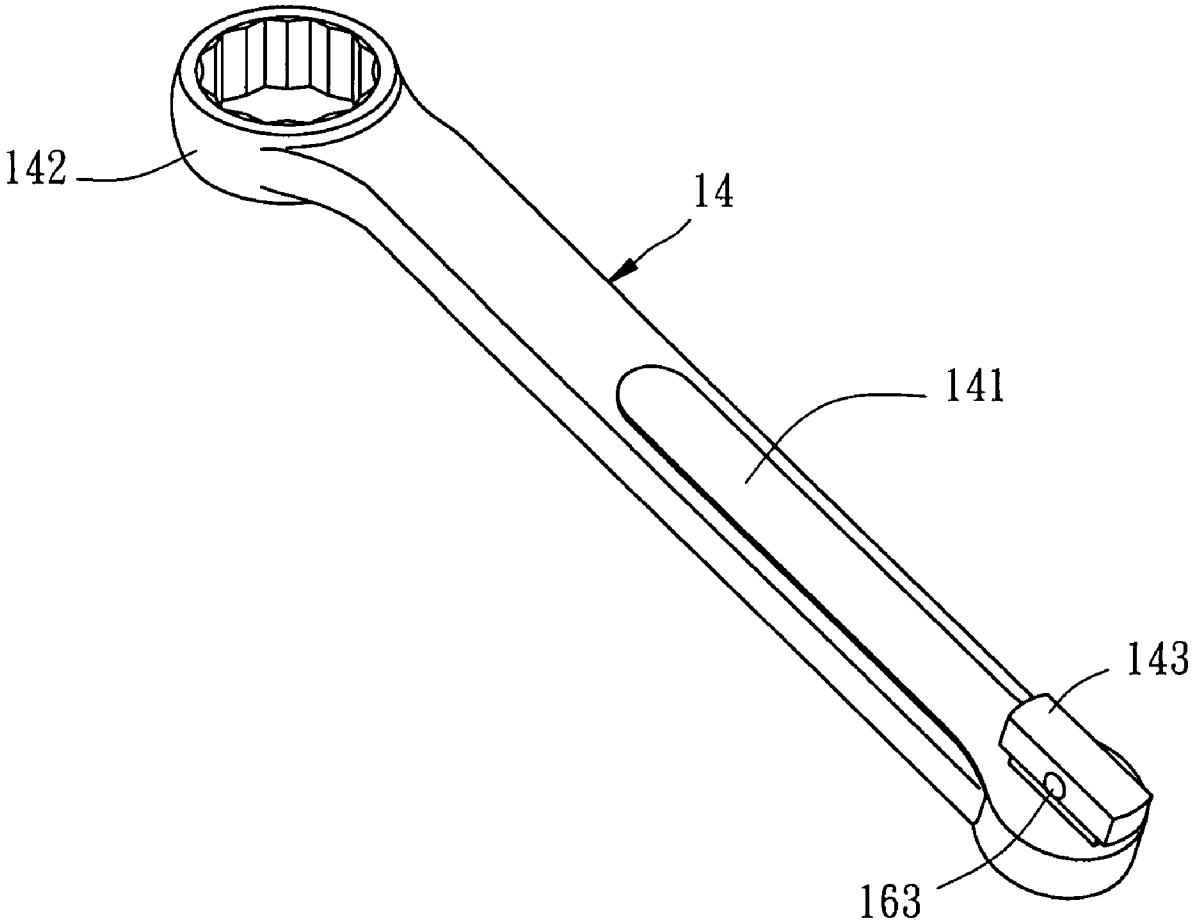
FIG. 7 is a perspective view of the second handle of the first preferred embodiment of the present invention.
Figure 8:
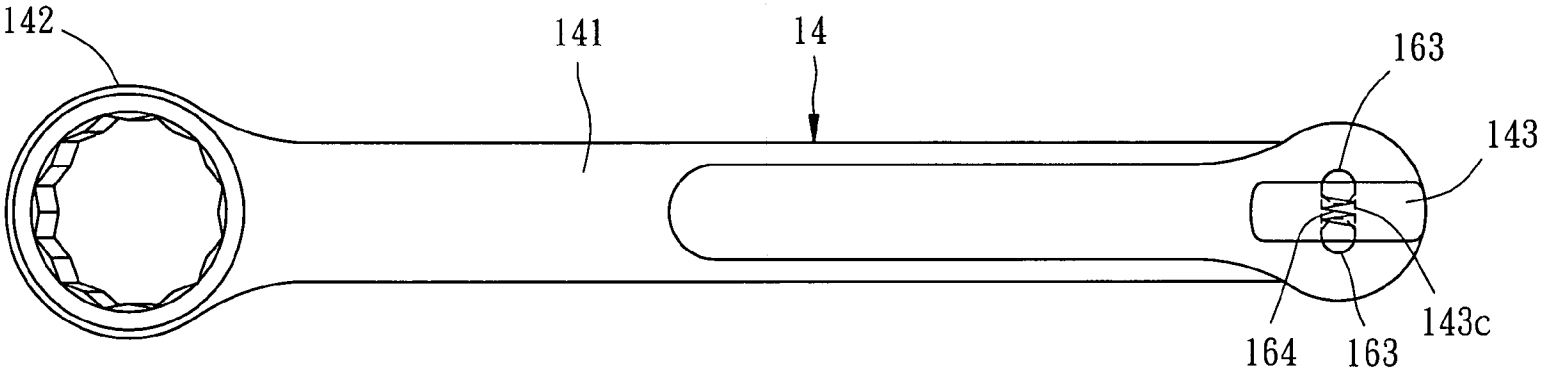
FIG. 8 is a top view of the second handle of the first preferred embodiment of the present invention.
Figure 9:
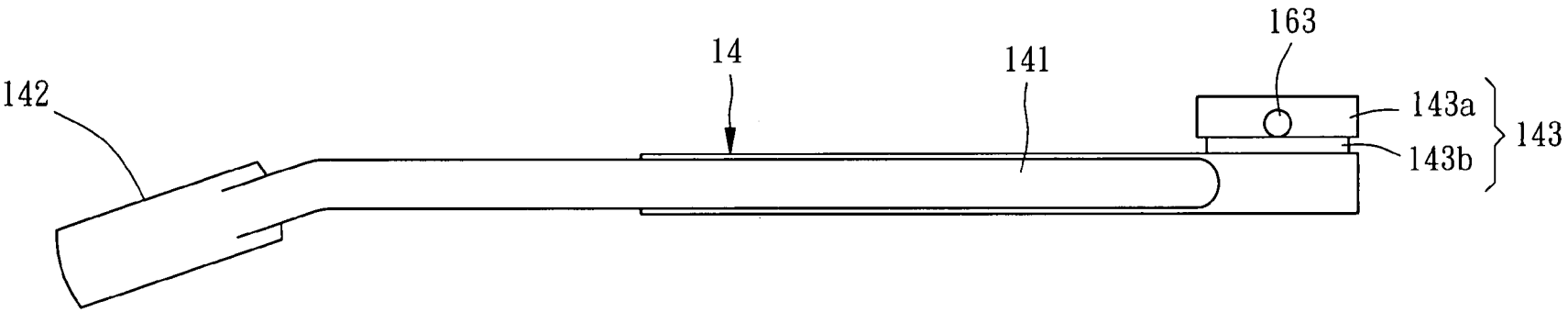
FIG. 9 is a front view of the second handle of the first preferred embodiment of the present invention.

As shown in FIG. 7 to FIG. 9, the second handle 14 has a body 141 with a predetermined length for holding by hand also, a second driving portion 142 and a connecting portion 143. The connecting portion 143 is an elongated protrusion. The second driving portion 142 can turn fasteners, such as bolt, nuts or other objects that is hard to be turned by hand. The protrusion 143 includes a head portion 143*a*, a neck portion 143*b* connecting the head portion 143*a* and the body 141 and a through hole 143*c* transversely through the head portion 143*a*.

The locking means 16 include an elongated slot 161, two positioning slots 162, two positioning members 163 and an elastic member 164. The positioning members 163 are two balls and the elastic member 164 is a spring. As shown in FIG. 6 and FIG. 8, the elongated slot 161 is provided on the body 121 of the first handle 12 with an end communicated with the round hole 123 and an opposite end extended toward the first driving portion 122. A stop wall 161*a* is projected from walls of the elongated slot 161 into the elongated slot 161. The positioning slots are on the opposite walls of the elongated slot 161. The balls 163 and the spring 164 are received in the through hole 143*c* of the protrusion 143 and the spring 164 has opposite ends urging the balls 163 outwardly.

Figure 10:
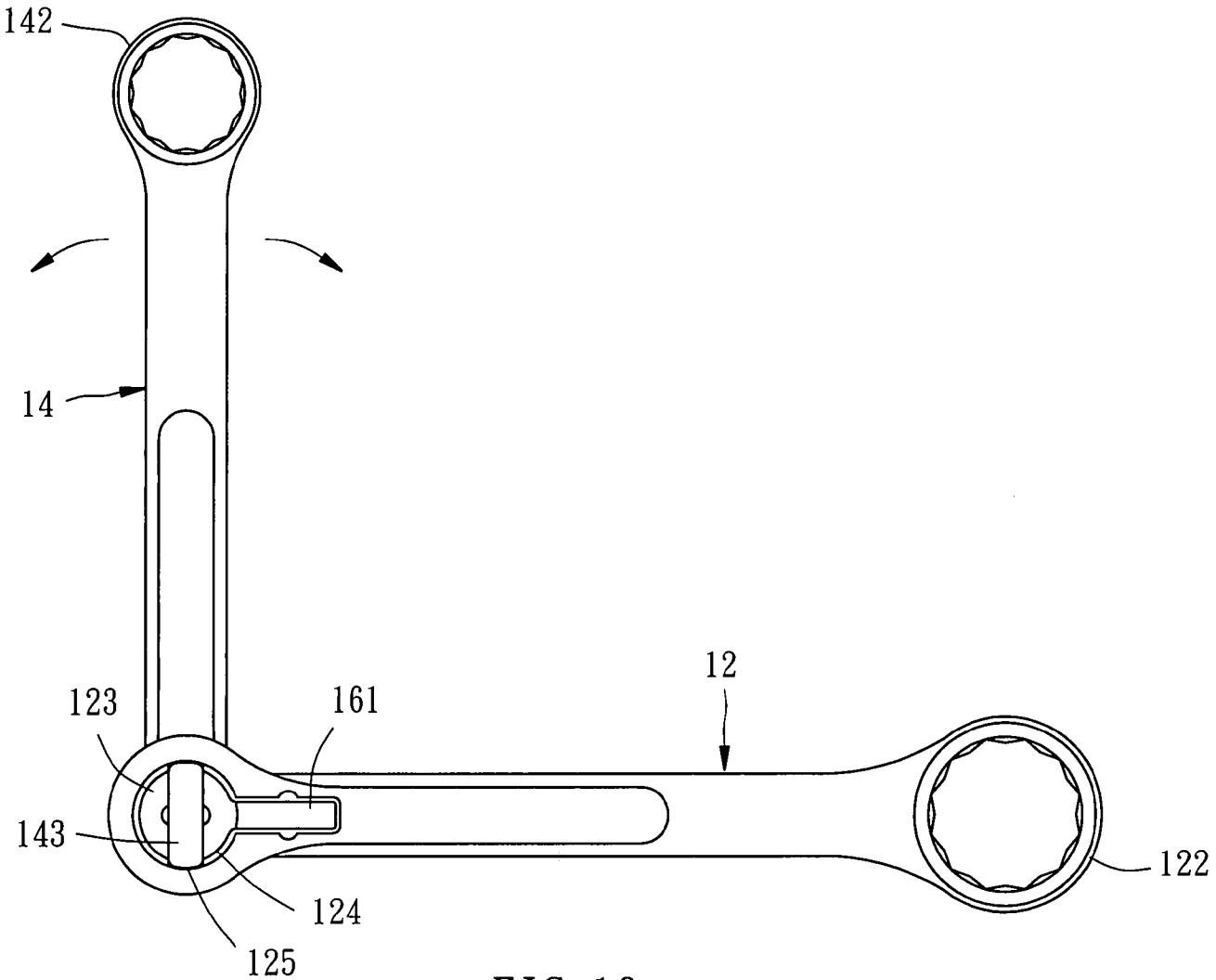
FIG. 10 is a top view of the first preferred embodiment of the present invention, showing the first handle and the second handle in a perpendicular condition.

As shown in FIG. 10, to combine the first handle 12 and the second handle 14, the protrusion 143 of the second handle 14 passes through the gaps 125 on the stop wall 124 of the first handle 12 to insert the protrusion 143 into the round hole 123. Next, the second handle 14 is turned clockwise or counterclockwise relatively to the first handle 12 to have the head portion 143*a* of the protrusion 143 locked with the stop wall 124, such that the first handle 12 is in connection with the second handle 14.

Figure 11:
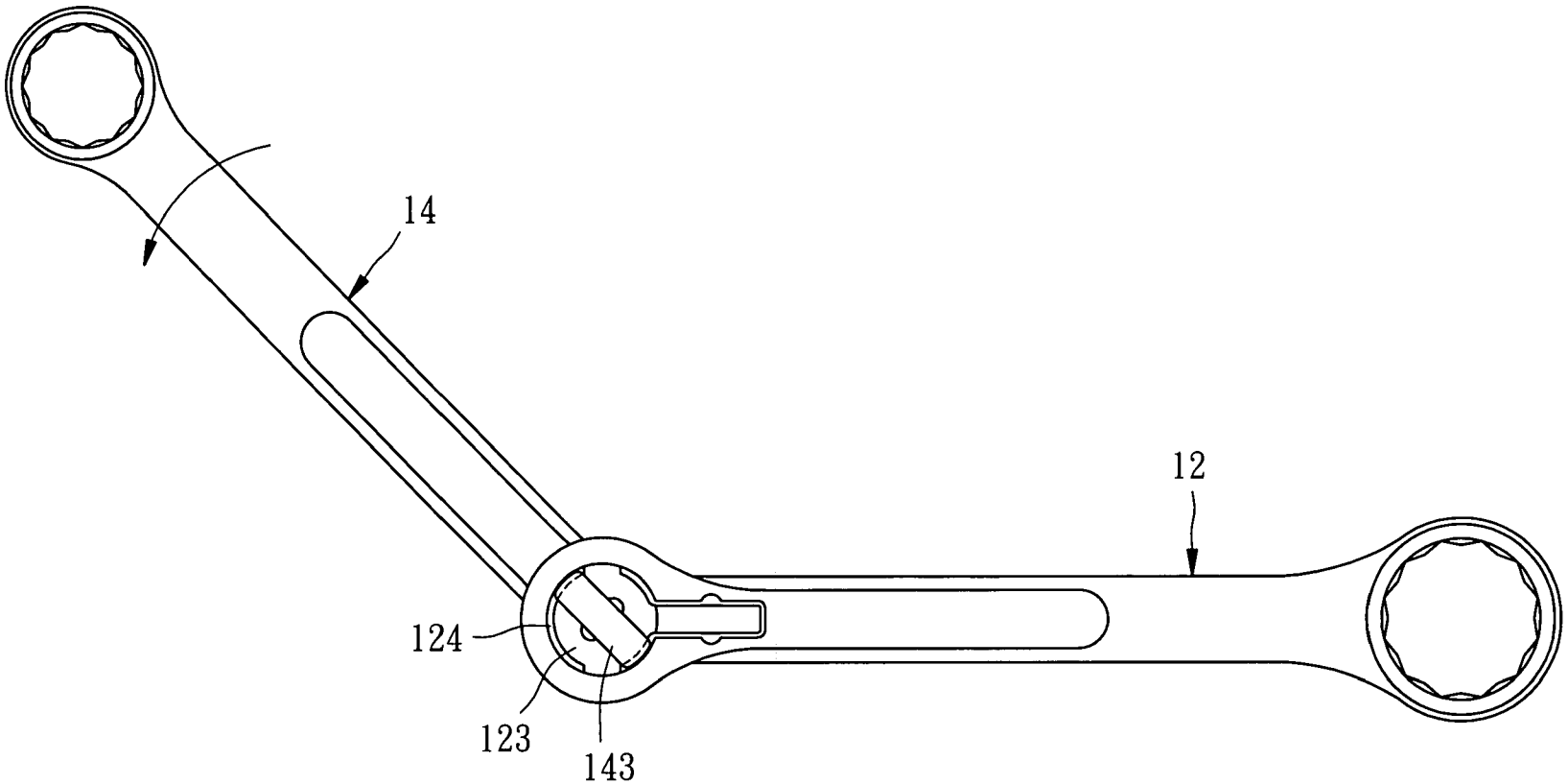
FIG. 11 to FIG. 13 are top views of the first preferred embodiment of the present invention, showing the first handle and the second handle turning from the perpendicular condition to a straight position.
Figure 12:
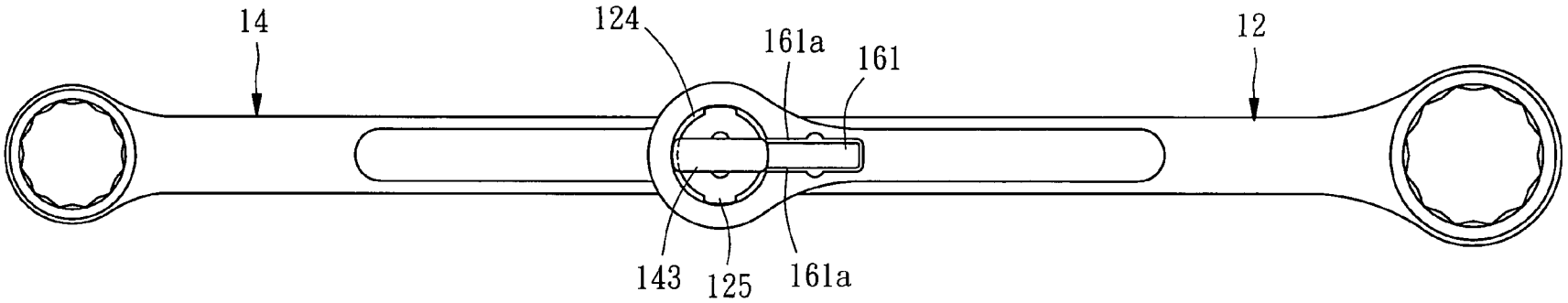
Figure 13:
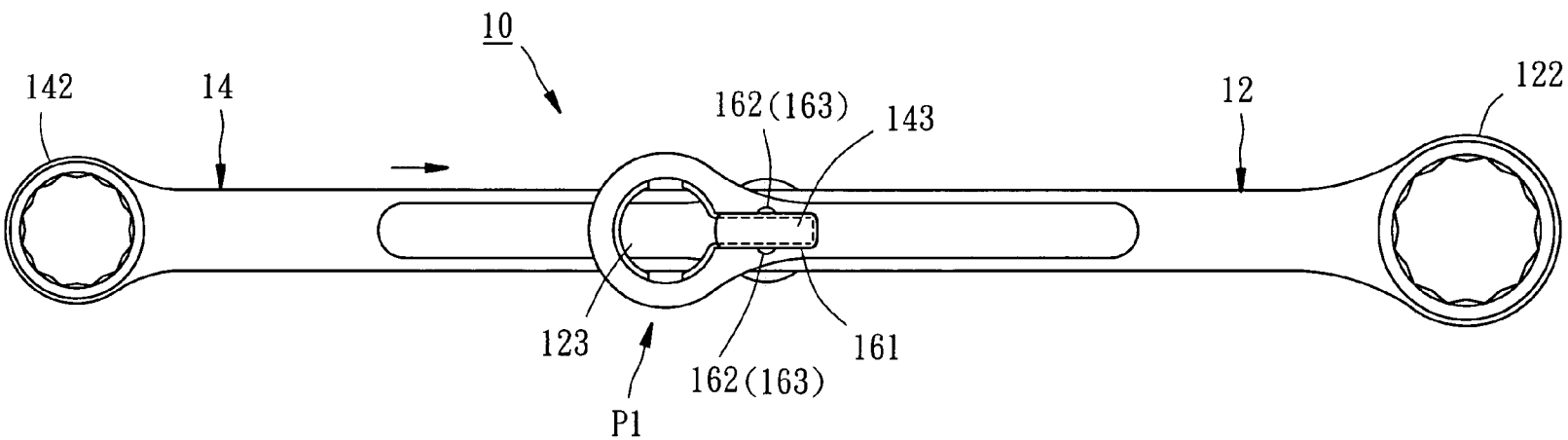

As shown in FIG. 11 and FIG. 12, the second handle 14 has the protrusion 143 engaged with the round hole 123 and is turned relative to the first handle 12 to a straight position (FIG. 12), and then the second handle 14 is moved to have the protrusion 143 into the elongated slot 161 along the stop wall 161*a* with the balls 163 received in the positioning slots 162 because of the spring 164 thereby the second handle 14 and the first handle 12 are secured in an unretracted position P1 (FIG. 13). In the unretracted position, there is the longest distance between the second driving portion 142 and the first driving portion 122 for operation.

Figure 14:
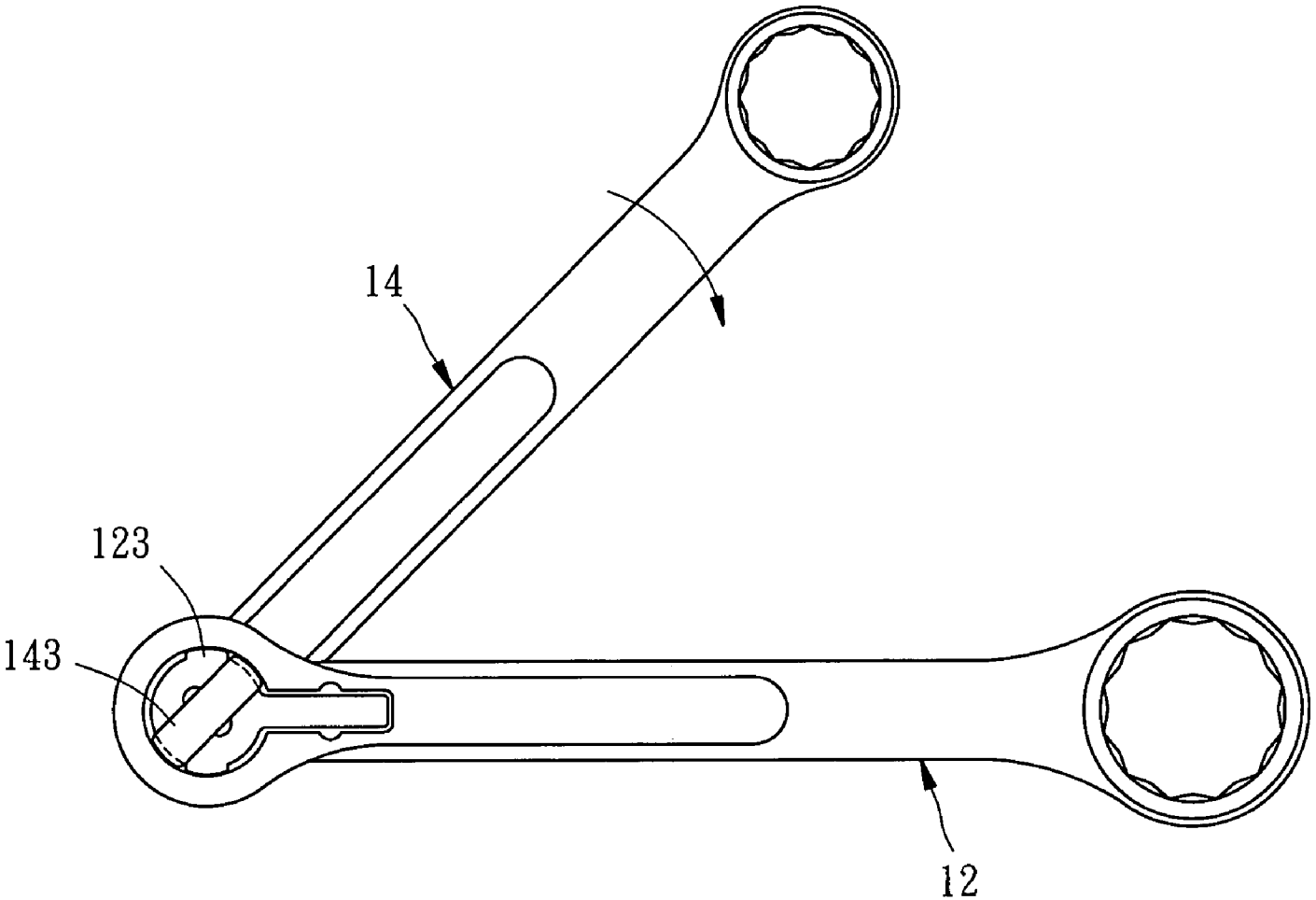
FIG. 14 to FIG. 16 are top views of the first preferred embodiment of the present invention, showing the first handle and the second handle turning from the perpendicular condition to an overlapped position.
Figure 15:
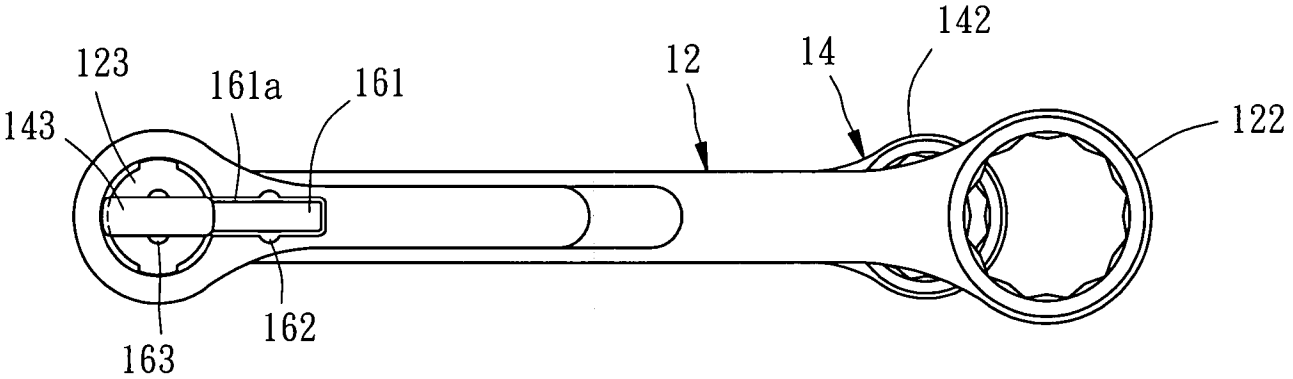
Figure 16:
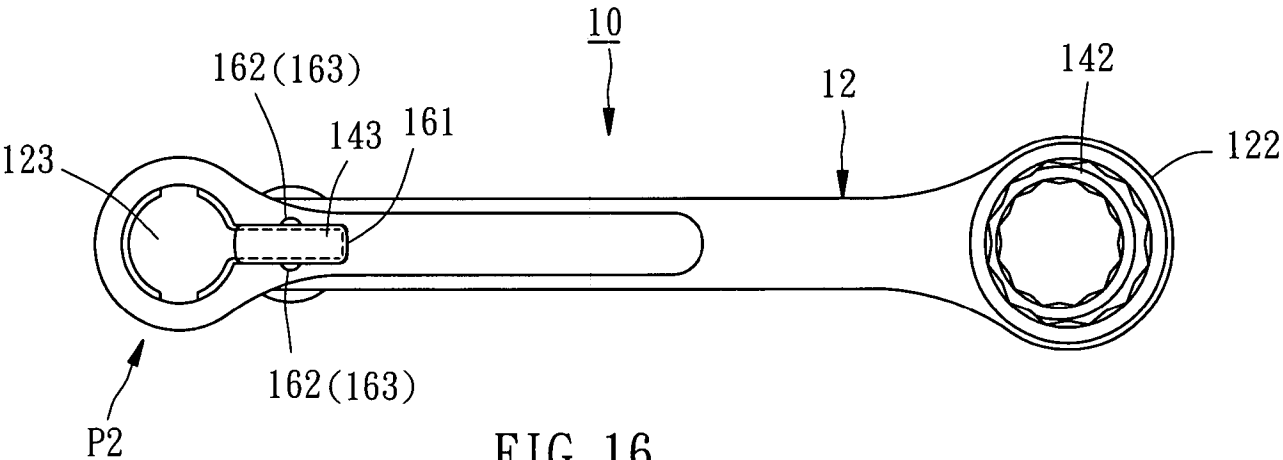

As shown in FIG. 14 and FIG. 15, the second handle 14 has the protrusion 143 engaged with the round hole 123 and is turned relative to the first handle 12 to an overlapped position (FIG. 15), and then the second handle 14 is moved to have the protrusion 143 into the elongated slot 161 with the balls 163 received in the positioning slots 162 because of the spring 164 thereby the second handle 14 and the first handle 12 are secured in a retracted position P2 (FIG. 16). In the retracted position P2, the second driving portion 142 is adjacent to the first driving portion 122, in other words, there is the shortest distance between the second driving portion 142 and the first driving portion 122 for storage. User also may move and turn the second handle 14 to have the protrusion 143 moving to the round hole 123 and aligned with the gaps 125 for separation of the first handle 12 and the second handle 14 for storage.

Figure 17:
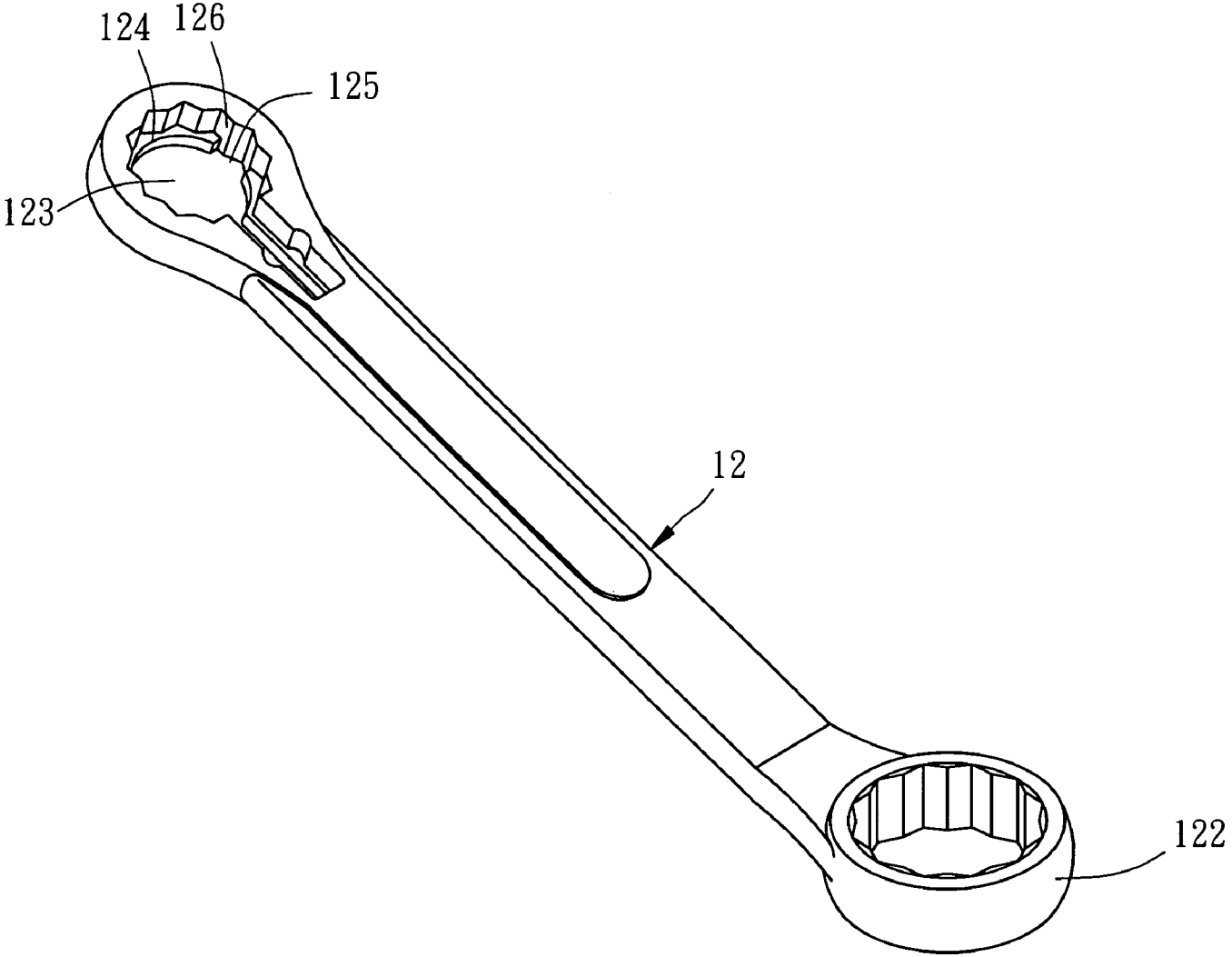
FIG. 17 shows another aspect of the first handle.

The first handle 12 may be provided with a third driving portion 126, which is a ratchet member, on the wall of the round hole 123, as shown in FIG. 17. The first handle 12 may turn a fastener by the third driving portion 126 when the first handle 12 is separated from the second handle 14.

Figure 18:
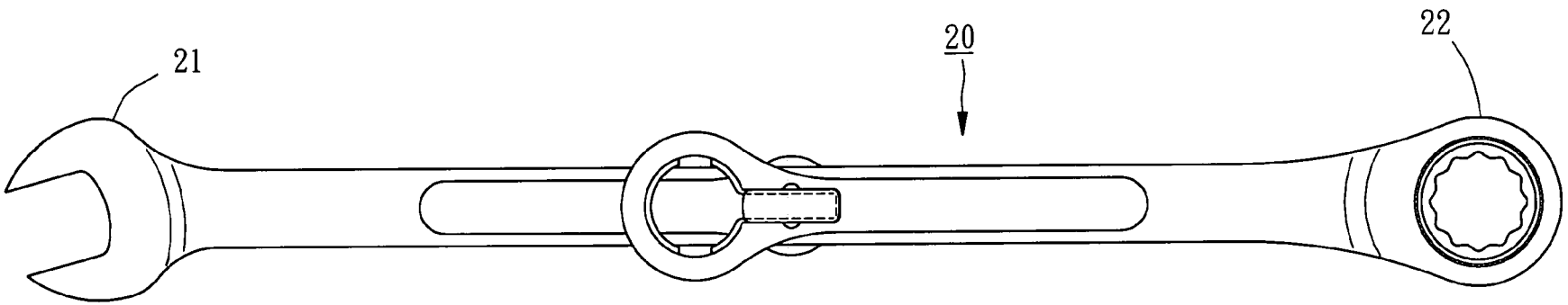
FIG. 18 shows the handheld tool of the present invention with different driving portions.

In the present invention, the first and second driving portions 122 and 142 are closed-end wrenching members (FIG. 4). It is easy to understand that the driving portions of the present invention may be various wrenching members as long as the driving portions don't affect rotation, movement, engagement and disengagement of the first handle 12 and the second handle 14. For example, FIG. 18 shows a tool 20 having an open-end driving portion 21 and a closed-end ratchet driving portion 22.

Figure 19:
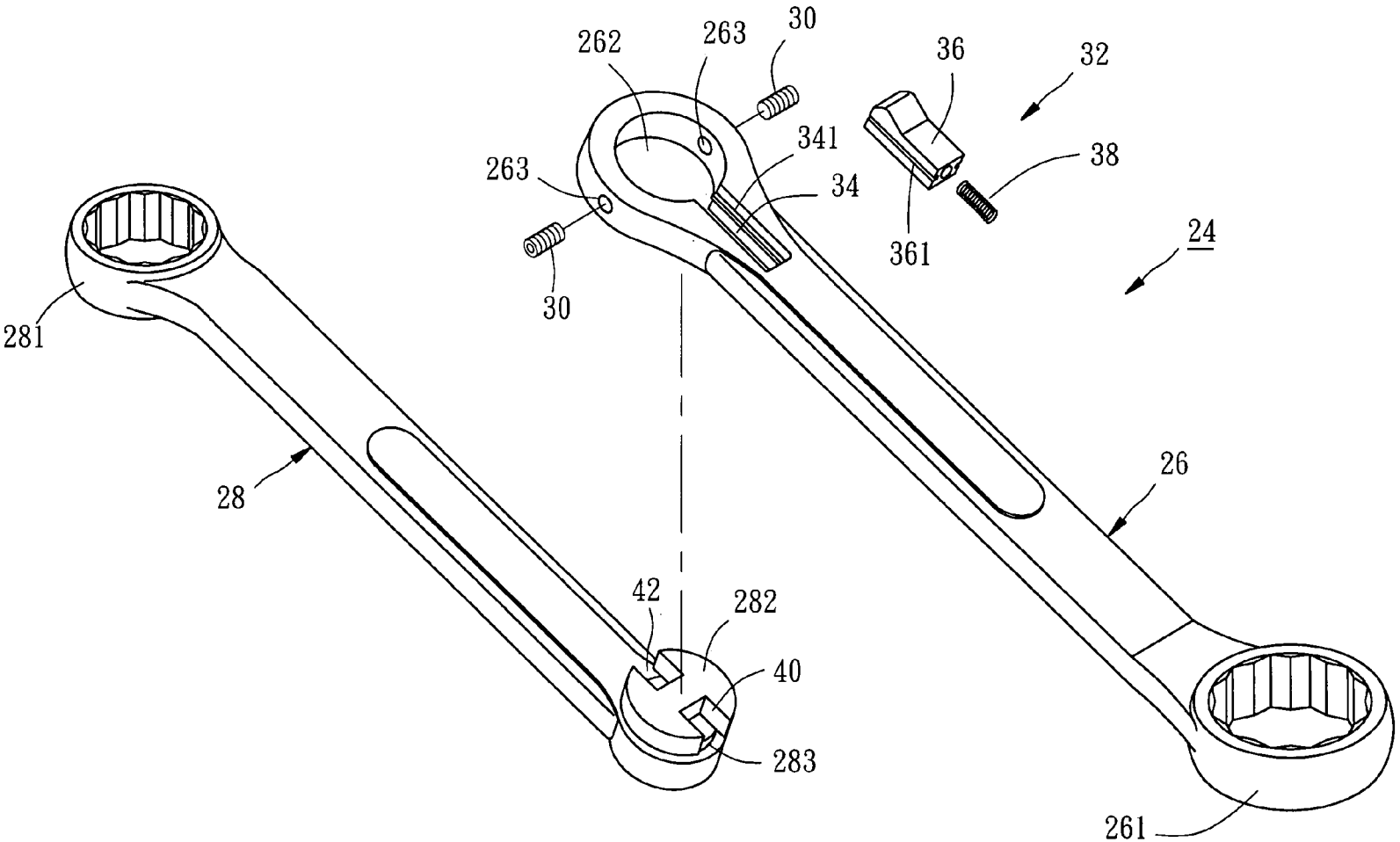
FIG. 19 is an exploded view of a second preferred embodiment of the present invention.
Figure 20:
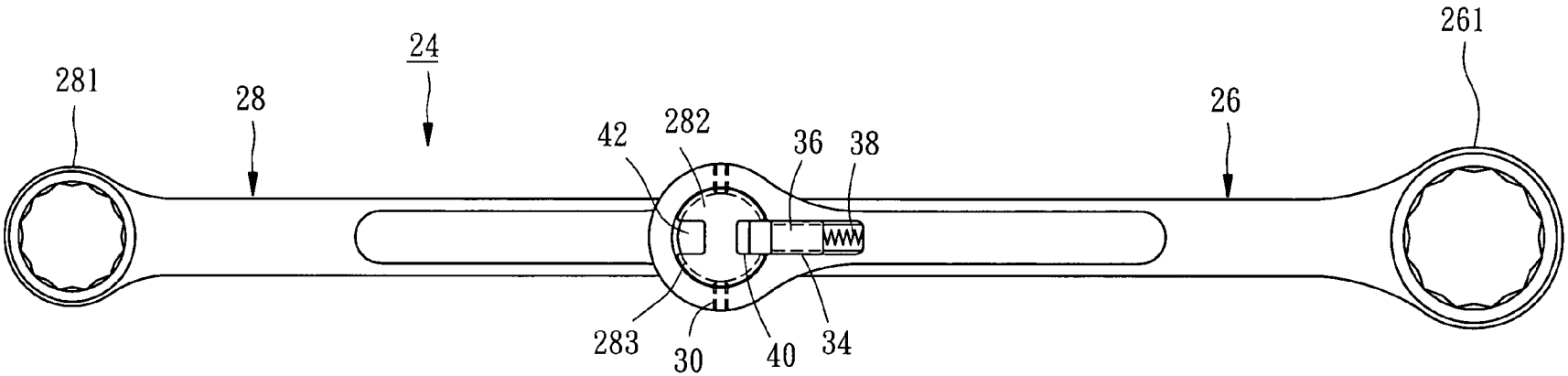
FIG. 20 shows the handheld tool of the second preferred embodiment of the present invention in operation condition.

FIG. 19 and FIG. 20 show a handheld tool 24 of the second preferred embodiment of the present invention, which is similar to the handheld tool 10 of the first preferred embodiment, except that the handheld tool 24 has a first handle 26 with a first driving portion 261 and a round hole 262 at opposite ends thereof. The first handle 26 further includes two side holes 263 communicated with the round hole 262.

A second handle 28 includes a second driving portion 281 and a round protrusion 282 for engagement of the round hole 262 of the first handle 26. The round protrusion 282 has an annular neck portion 283 associated with the side holes 263. Two pin-like locking members 30 are inserted into the side holes 263 and received in the annular neck portion 283, such that the first handle 26 and the second handle 28 are combined together and the first handle 26 may rotate relative to the second handle 28.

A locking device 32 includes an elongated slot 34, a locking member 36, a biasing member 38, a first locking slot 40 and a second locking slot 42.

The elongated slot 34 is on the first handle 26 with an end thereof communicated with the round hole 262. Two protrusions 341 are projected from opposite walls of the elongated slot 34.

The locking member 36 is a block with two slots 341 on opposite sides thereof to be engaged with the protrusions 341 respectively. Therefore, the locking member 34 is received in the elongated slot 34 of the first handle 26 and moved along the elongated slot 26. The locking member 36 may be moved toward the round hole 262 with an end into the round hole 262 or moved away from the round hole 262 to be totally received in the elongated slot 34.

The biasing member 38, which is a spring, is received in the elongated slot 34 with opposite ends urging a rear end of the locking member 36 and the wall of the elongated slot 34 to urge the locking member 36 toward the round hole 262.

Figure 21:
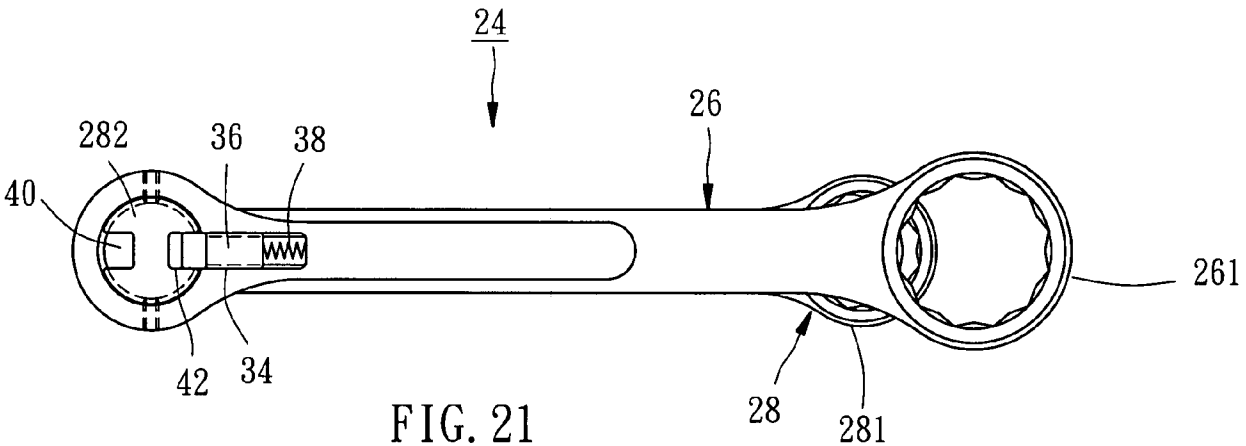
FIG. 21 shows the handheld tool of the second preferred embodiment of the present invention in storage condition.

The first and the second locking slots 40, 42 are provided on the round protrusion 282. As shown in FIG. 20, the first locking slot 40 is aligned with the elongated slot 34 when the second handle 28 is turned relative to the first handle to a straight portion (the unretracted position). At this moment, the spring 38 urges a front section of the locking member 36 into the first locking slot 40 and a rear section of the locking member 36 still remains in the elongated slot 34 to prevent the second handle 28 from rotation relative to the first handle 26. The second handle 28 is free for rotation when the locking member 36 is moved out of the first locking slot 40, and then the second handle 28 may be turned to an overlapped position (a retracted portion). At this moment, the spring 38 urges the front section of the locking member 36 into the second locking slot 42 and the rear section of the locking member 36 still remains in the elongated slot 34 to prevent the second handle 28 from rotation relative to the first handle 26, as shown in FIG. 21, for storage.

Figure 22:
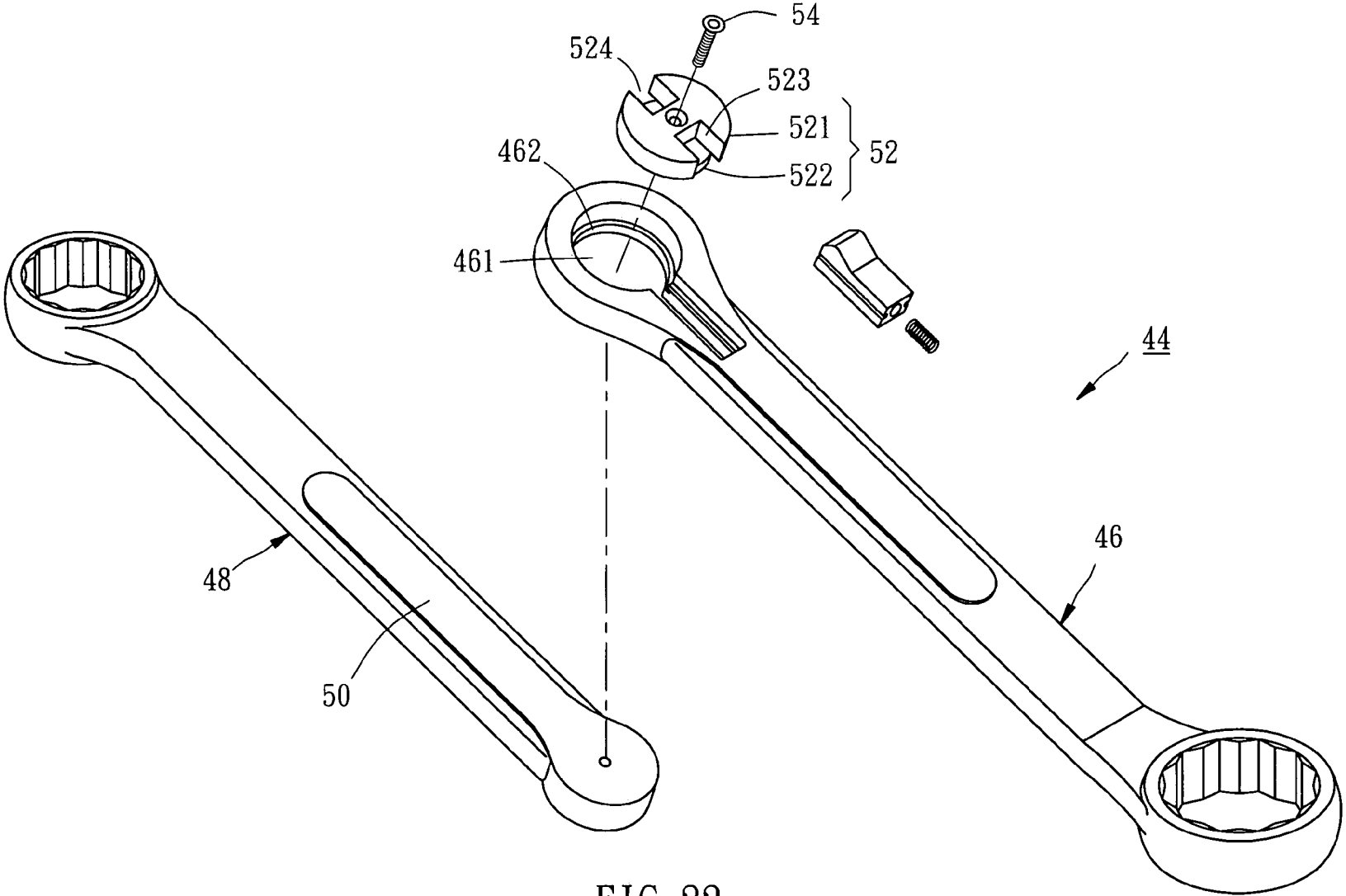
FIG. 22 is an exploded view of a third preferred embodiment of the present invention.

FIG. 22 shows a handheld tool 44 of the third preferred embodiment of the present invention, which is similar to the handheld tool 24 of the second preferred embodiment, except that the handheld tool 44 includes a first handle 46 with a round hole 461 and a narrow diameter portion 462 (so called stop wall) at a bottom of a wall of the round hole 461. A second handle 48 has a body 50 and a round protrusion 52. The round protrusion 52 has a first diameter portion 521 and a second diameter portion 522. The first diameter portion 521 has a diameter identical to that of the round hole 461. The first diameter portion 521 has a first locking slot 523 and a second locking slot 524. In assembly, the body 50 is positioned under the first handle 46 to engage the round protrusion 52 with the round hole 461 with the second diameter portion 522 passing through the narrow diameter portion 462. After that, a fixing device 54 is inserted into the round protrusion 52 and the body to connect the first handle 46 and the second handle 48. The operation of the handheld tool 44 of the third preferred embodiment is as same as the handheld tool above.

The description above is a few preferred embodiments of the present invention and the equivalence of the present invention is still in the scope of the claim of the present invention.

What is claimed is:

1. A handheld tool, comprising:

a first handle;

a second handle connected to the first handle to be turned relative to the first handle between a retracted position and an unretracted position, wherein the second handle is located under the first handle when the second handle is turned to the retracted position; and locking means for securing the second handle to the first handle when the second handle is turned to the unretracted position;

wherein the first handle has a turning space at an end thereof, and the second handle has an elongated protrusion at an end thereof, and the locking means includes an elongated slot communicated with the turning space and at least one positioning member, wherein the second handle has the protrusion engaged with the turning space for switching between the retracted position and the unretracted position and the protrusion enters the elongated slot with the positioning member securing the protrusion in the elongated slot when the second handle is turned to the unretracted position; and wherein the turning space of the first handle is a round hole and the first handle further includes a stop wall on a wall of the round hole and a wall of the elongated slot, and the protrusion of the second handle includes a head portion and a neck portion, wherein the neck is associated with the stop wall whereby the neck portion is against the stop wall when the neck portion is in the round hole or in the elongated slot.

2. The handheld tool as defined in claim 1, wherein the head portion of the protrusion of the second handle includes a through hole and an elastic member therein, and the positioning member is a ball received in the through hole, and the first handle has a positioning slot on the wall of the elongated wall, wherein the elastic member urges the ball into the positioning slot when the protrusion is received in the elongated slot.

3. The handheld tool as defined in claim 2, wherein the first handle has at least one gap on the stop wall of the round hole to pass through the protrusion of the second handle for access of the round hole.

4. A handheld tool, comprising:

a first handle having a first driving portion and a turning portion at opposite ends thereof; and a second handle, which is located under the first handle, having second driving portion and a connecting portion to be connected to the turning portion of the first handle for turning relative to the first handle between a retracted position and an unretracted position, wherein the second driving portion of the second handle is adjacent to the first driving portion of the first handle when the second handle is turned to the retracted position, and the second driving portion keeps a longest distance from the first driving portion when the second handle is turned to the unretracted position;

wherein the turning portion of the first handle is a round hole, and the first handle further includes an elongated slot communicated with the round hole, and the connecting portion of the second handle is an elongated protrusion to be engaged with the round hole for turning the second handle between the retracted position and the unretracted position, and the protrusion enters the elongated slot when the second handle is turned to the unretracted position; and wherein the first handle includes a stop wall at bottom sides of the round hole and the elongated slot, and the protrusion of the second handle includes a head portion and a neck portion, wherein the neck portion is engaged with the stop wall to make the head portion against the stop wall when the head portion is in the round hole and in the elongated slot.

5. The handheld tool as defined in claim 4, wherein the second handle includes a through hole on the head portion of the protrusion, and the first handle includes a positioning slot on a wall of the elongated slot, and a ball is received in the through hole to be received in the positioning slot by urging by an elastic member when the protrusion enters the elongated slot.

6. The handheld tool as defined in claim 4, wherein the first handle includes at least a gap on the stop wall around the round hole for accessing the protrusion of the second handle.

7. A handheld tool, comprising:

a first handle;

a second handle connected to the first handle to be turned relative to the first handle between a retracted position and an unretracted position, wherein the second handle is located under the first handle when the second handle is turned to the retracted position; and locking means for securing the second handle to the first handle when the second handle is turned to the unretracted position;

wherein the first handle has a turning space at an end thereof, and the second handle has an elongated protrusion at an end thereof, and the locking means includes an elongated slot communicated with the turning space and at least one positioning member, wherein the second handle has the protrusion engaged with the turning space for switching between the retracted position and the unretracted position and the protrusion enters the elongated slot with the positioning member securing the protrusion in the elongated slot when the second handle is turned to the unretracted position;

wherein the first handle has a first driving portion opposite the turning space; and wherein the second handle has a third driving portion on a wall of the turning portion.

8. The handheld tool as defined in claim 7, wherein the second handle has a second driving portion opposite the protrusion.

9. A handheld tool, comprising:

a first handle;

a second handle connected to the first handle to be turned relative to the first handle between a retracted position and an unretracted position, wherein the second handle is located under the first handle when the second handle is turned to the retracted position;

locking means for securing the second handle to the first handle when the second handle is turned to the unretracted position;

wherein the first handle has a round hole at an end thereof, and the second handle has a round protrusion at an end thereof to be engaged with the round hole, and the locking means includes an elongated slot on the first handle, a locking member received in the elongated slot, and at least one locking slot on the round protrusion, wherein the elongated slot has an end communicated with the round hole, and the locking member has a front section entering the locking slot on the round protrusion and a rear section remaining in the elongated slot when the second handle is turned to the unretracted position.

10. The handheld tool as defined in claim 9, further comprising a biasing member received in the elongated slot to urge the locking device toward the round hole of the first handle.

11. The handheld tool as defined in claim 10, wherein the at least one locking slot of the locking means includes a first locking slot and a second locking slot, wherein the locking member has the front section entering the first locking slot when the second handle is turned to the unretracted position and the front section entering the second locking slot when the second handle is turned to the retracted position.

12. The handheld tool as defined in claim 9, further comprising a second locking member, wherein the first handle includes at least a side hole communicated with the round hole to receive the second locking member, and the second handle includes an annular neck portion on the round protrusion to receive a front end of the second locking member.

13. The handheld tool as defined in claim 9, further comprising at least a fixing device, wherein the first handle includes a narrow diameter portion at a bottom side of the round hole, and the second handle includes a body and the round protrusion, and the round protrusion has a first diameter portion and a second diameter portion, and a diameter of the first diameter is identical to the round hole, and the second diameter portion passes through the narrow diameter portion, and the fixing device connects the round protrusion and the body.

14. The handheld tool as defined in claim 9, wherein the first handle has a first driving portion at an end thereof opposite to the round hole.

15. The handheld tool as defined in claim 14, wherein the second handle has a second driving portion at an end thereof opposite to the round protrusion.

* * * * *